US006247841B1

(12) United States Patent
Erard

(10) Patent No.: US 6,247,841 B1
(45) Date of Patent: Jun. 19, 2001

(54) DEVICE FOR ACTUATING A MECHANISM FOR A WATCH CASE OF NON CIRCULAR SHAPE

(75) Inventor: Francis Albert Erard, La Chaux-de-Fonds (CH)

(73) Assignee: Grandjean Sarl, La Chaux-de-Fonds (CH)

( * ) Notice: Subject to any disclaimer, the term of this patent is extended or adjusted under 35 U.S.C. 154(b) by 0 days.

(21) Appl. No.: 09/388,490

(22) Filed: Sep. 2, 1999

(30) Foreign Application Priority Data

Sep. 10, 1998 (EP) ..... 98117141

(51) Int. Cl.[7] ..... G04B 29/00
(52) U.S. Cl. ..... 368/308; 368/319
(58) Field of Search ..... 368/69, 110–113, 368/185–187, 190, 319–321, 306–308

(56) References Cited

U.S. PATENT DOCUMENTS 2,360,113 * 10/1944 Drescher ..... 368/190
3,759,033 9/1973 Jeanmonod ..... 58/74
4,092,821 * 6/1978 Wirz ..... 368/187
4,364,674 12/1982 Tesch ..... 368/319

FOREIGN PATENT DOCUMENTS 211143 8/1940 (CH) .
598 631 5/1978 (CH) .
2 207 386 8/1972 (DE) .
0 443 087 8/1991 (EP) .
2 435 077 3/1980 (FR) .

* cited by examiner

*Primary Examiner*—Vit Miska
(74) *Attorney, Agent, or Firm*—Griffin & Szipl, P.C.

(57) ABSTRACT

A device for actuating a timepiece mechanism, in particular a chronograph mechanism, this timepiece including a fitting ring (12) having an opening (14) for accommodating a movement (16), an independent push-button (4*a*, 4*b*) sliding along a first direction (D1), a piston (18*a*, 18*b*) sliding along a second direction (D2, D3) in the fitting ring (12), said piston (18*a*, 18*b*) being intended to co-operate with a component of the movement and a push transmission element to transmit a push of said pushbutton (4*a*, 4*b*) to said piston (18*a*, 18*b*), characterized in that the push transmission element includes a rigid actuation lever (22*a*, 22*b*) articulated at one point (P) on the fitting ring (12) and in the plane thereof.

13 Claims, 2 Drawing Sheets

DEVICE FOR ACTUATING A MECHANISM FOR A WATCH CASE OF NON CIRCULAR SHAPE

The present invention concerns a device for actuating a mechanism for a watch case of non circular shape and more particularly a device of this type for actuating a chronograph mechanism mounted in a square or rectangular watch case.

There presently exists an increasing demand for wrist-watches having a square, rectangular or tonneau case. Fitting conventional circular movements to this type of case does not pose any particular problem when one wishes to make watches which do not require the use of push-buttons. It is different however when one makes watches including pushes, such as chronograph watches and one wishes, for obvious reasons of cost, to use circular movements. Indeed, it is difficult to fit to this type of watch case conventional push-buttons which act directly and in accordance with a radial direction to the movement on the mechanisms to be actuated.

Swiss Patent No. 211 1430 discloses a device for actuating a chronograph mechanism for a square watch case which attempts to overcome this problem.

According to this document, the device includes a fitting ring for a square case, intended to accommodate a circular movement. The fitting ring includes over one portion of its periphery two elastic leaves fixed respectively by one of their ends at 2 o'clock and 4 o'clock. The leaves extend tangential to the opening intended to accommodate the movement and their free end includes an actuating stub oriented towards the centre of the fitting ring. Two independent push-buttons of the movement are adjusted in openings made in one of the sides of the case and respectively allow the free ends of the leaves to be actuated, said ends acting in turn on levers and/or pivoting parts of the movement to control the stop, start and reset to zero of the chronograph.

Such a device has however numerous drawbacks.

The manipulation of the push-buttons causes deformation of the elastic leaves, and thus the travel of the leaves has no effect, before the levers or pivoting parts are actuated to switch the chronograph on or off. This phenomenon leads to a delay in the starting or stopping of the chronograph mechanism and thus leads to a loss of timing precision.

The elasticity of the leaves also does not allow precise and direct transmission of the movement of the push-buttons and leads to the risk of the device locking.

Another drawback of this device lies in the fact that it is necessary to adapt the shape of the inner ends of the push-buttons to allow them to slide adequately on the leaves, which means that it is impossible to use conventional push-buttons and makes the device more expensive.

Another drawback of this device lies in the fact that the selection and treatment of the leaves as regards adjustment of their return force is difficult to control, which leads either to a device which is difficult for the user to actuate, or a device which can be inadvertently stored.

It will also be noted in this regard that the mounting and fitting of the leaves onto the fitting ring are complex and difficult operations, which increases the cost price of the device.

The main object of the present invention is thus to overcome the drawbacks of the aforementioned prior art, by providing a device for actuating a mechanism, in particular a chronograph, which allows a circular movement to be fitted easily into a square, rectangular or tonneau case which comprises push buttons, and which is of simple, reliable and economic design.

Another object of the present invention is to provide such an actuating device which allows conventional push-buttons to be used.

The invention thus concerns a device for actuating a timepiece mechanism, in particular a chronograph mechanism, this timepiece including a fitting ring having an opening for accommodating a movement, an independent push-button sliding along a first direction, a piston sliding along a second direction in the fitting ring, said piston being intended to co-operate with a component of the movement and a push transmission element to transmit a push of said push-button to said piston, characterised in that the push transmission element includes a rigid actuation lever articulated at one point on the fitting ring and in the plane thereof.

Thus, as a result of the rigidity of the actuation lever, each push action on the push-button is transmitted wholly and without delay onto the component of the movement to be actuated, which gives the user a sense of quality and reliability.

It will further be noted that the actuation device according to the invention does not include any springs on the fitting ring, but advantageously uses the return springs respectively of the push-button and the component of the movement to be actuated, which makes the device simple and reliable.

This actuation device also has the advantage of not requiring any adjustment operation other than the standard adjustment operations for push-buttons and the components of the movement to be actuated.

According to an advantageous feature of the invention, the lever includes a first push surface co-operating with said piston, and a second push surface co-operating with said push-button.

According to another advantageous feature of the invention, the first and the second surfaces are respectively at different distances from the point of articulation of the lever, the second surface being further from the point of articulation than the first surface. This arrangement allows the force which has to be applied to the push-button to actuate the component of the movement to be reduced, which thus increases the ease of use for the user.

Other features and advantages of the present invention will appear from the following description of a preferred embodiment, given by way of non-limiting example with reference to the annexed drawings, in which.

Figure 1:
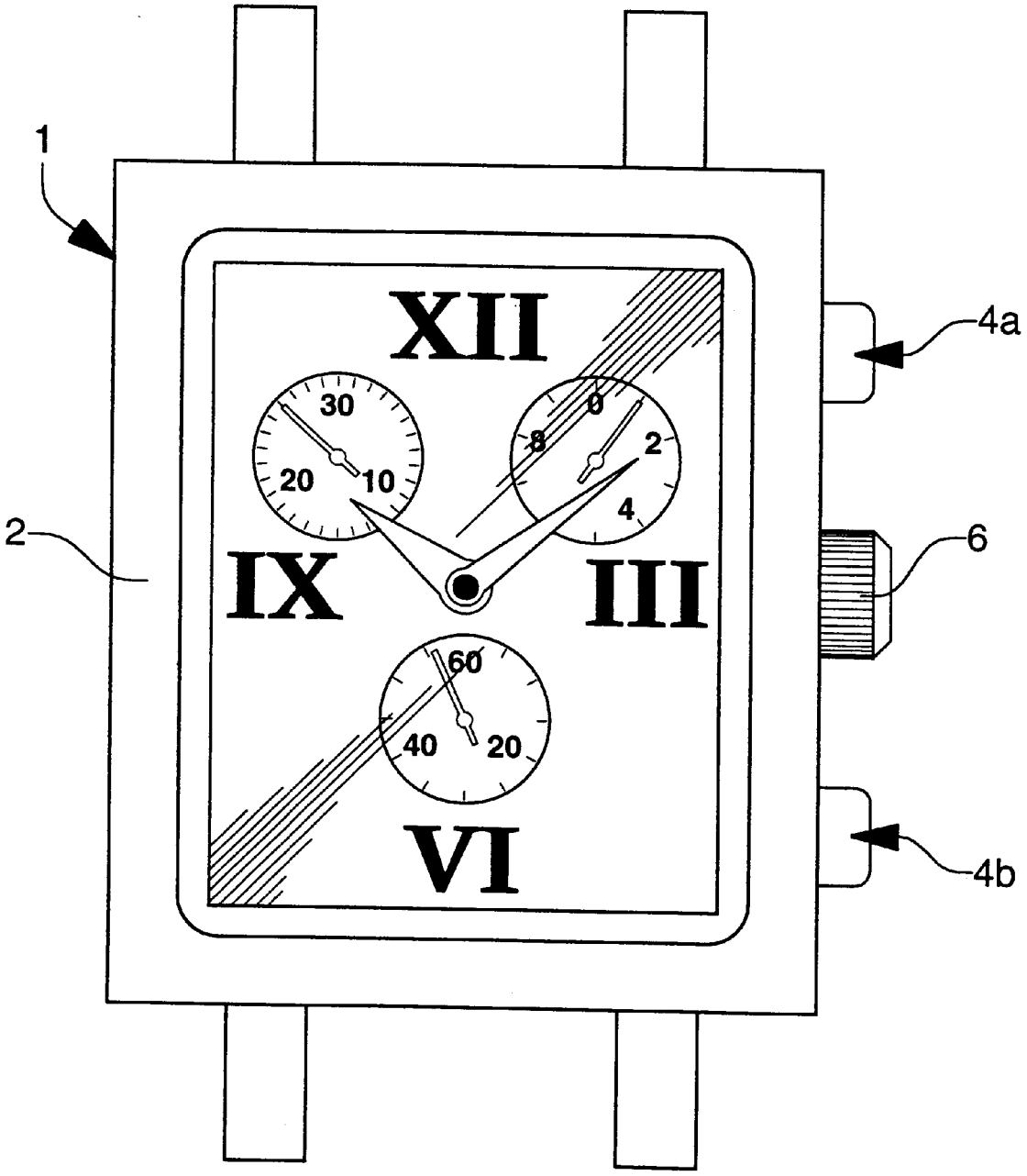
FIG. 1 is a plane view of a chronograph-watch fitted with an actuation device for its chronograph mechanism according to the invention.

The plane view of FIG. 1 illustrates a chronograph-watch fitted with an actuation device for its chronograph mechanism according to the invention. The watch includes a case 1 having in particular a middle part 2 of rectangular shape and including two independent push-buttons 4*a* and 4*b* of a conventional type, arranged on one side of case 1, respectively at 2 o'clock and 4 o'clock, as well as a conventionally time setting crown 6, arranged on the same side at 3 o'clock.

Figure 2:
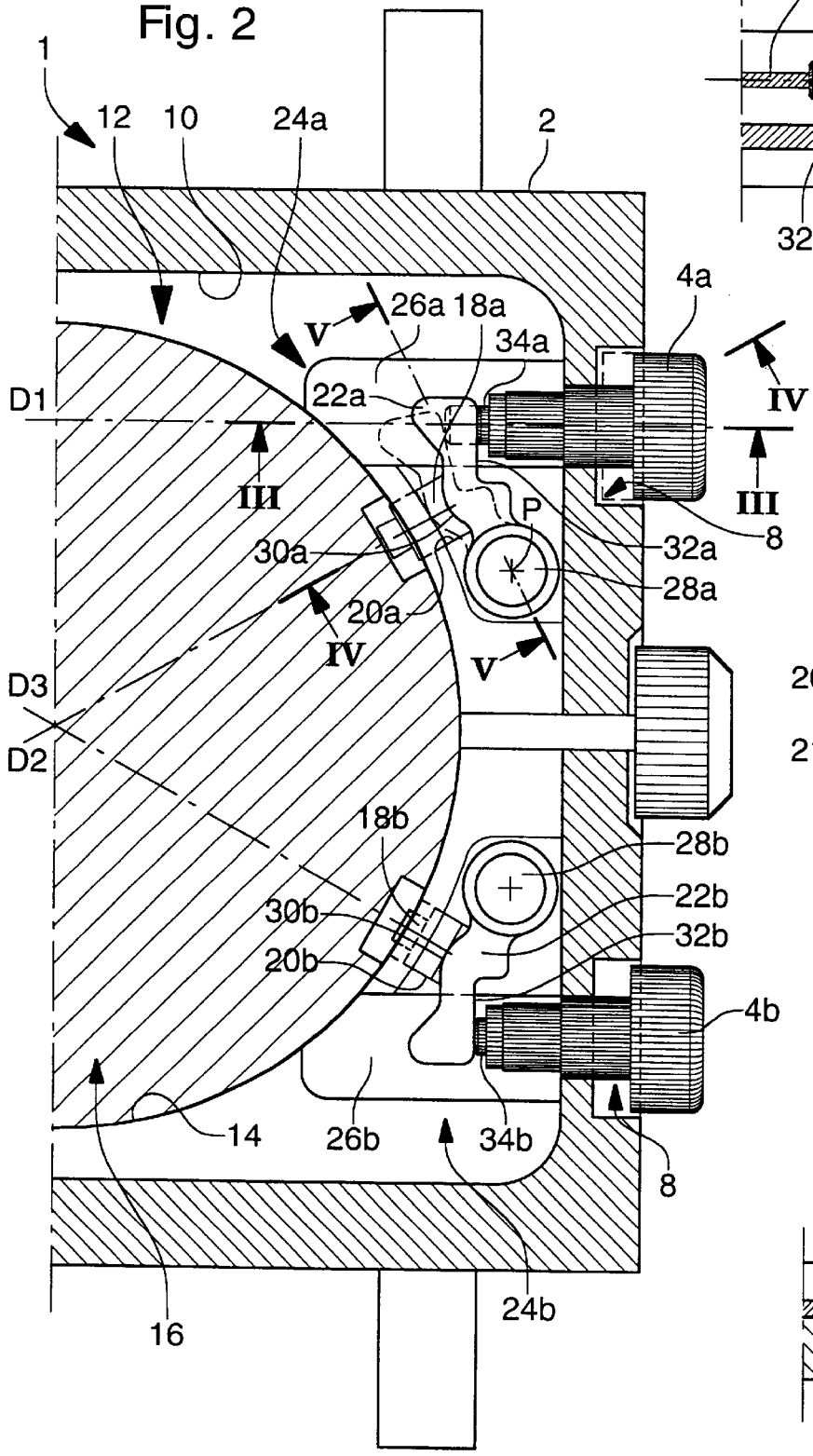
FIG. 2 is a plane semi-view of a fitting ring showing the actuation device according to the invention the case being partially shown.
Figure 3:
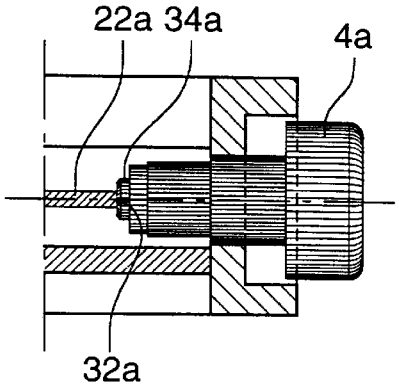
FIG. 3 is a cross-section along the line III—III of FIG. 2.

With reference to FIG. 2, it can be seen that push-buttons 4*a* and 4*b* are screwed or driven into middle part 2 in openings 8 provided for this purpose. Each push-button 4*a* and 4*b* slides in middle part 2 along a first direction D1 parallel to the 9 o'clock–3 o'clock axis. FIG. 2 also shows that middle part 2 includes a central opening 10 of square shape into which is fitted a fitting ring 12 having an outer contour of complementary shape, in this case square. Fitting ring 12 includes an opening 14 into which is fitted a conventional clockwork movement 16 (shown schematically) which can be mechanical or electronic. In the example described, it is a chronograph movement whose mechanism is actuated by two pistons 18*a* and 18*b* which slide respectively freely along a second and third direction D2 and D3, different to first direction D1 in bores 20*a* and 20*b* arranged in the thickness of fitting ring 12. In this example, the second and third directions D2 and D3 are radial with respect to the movement and extend respectively parallel to the 10 o'clock–4 o'clock axis and the 8 o'clock–2 o'clock axis. Piston 18*a* acts radially on the levers and pivoting parts for starting and stopping the chronograph, while piston 18*b* acts radially on the zero reset levers and pivoting parts.

Figure 4:
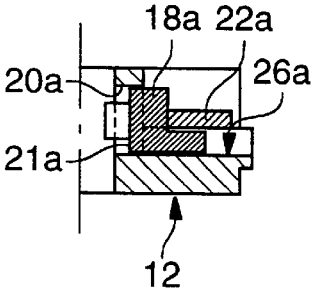
FIG. 4 is a cross-section along the line IV—IV of FIG. 2.

It will be noted in this regard that pistons 18*a* and 18*b* respectively include axial stop surfaces 21*a* (FIG. 4) which stop the radial sliding of pistons 18*a*, 18*b* towards the interior of fitting ring 12. These stop surfaces 21*a* are of course provided to allow the end of pistons 18*a*, 18*b* to enter the circumference of fitting ring 12 over a travel sufficient to actuate the components of the movement to be actuated.

The actuation device further includes push transmission elements 22*a* and 22*b* for transmitting pressure applied respectively onto push-buttons 4*a*, 4*b* to pistons 18*a* and 18*b*. According to a feature of the invention, elements 22*a* and 22*b* have the form of a rigid actuation lever which is respectively articulated at a point P in peripheral portions 24*a* and 24*b* of fitting ring 12.

Figure 5:
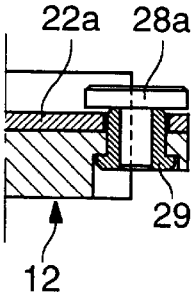
FIG. 5 is a cross-section along the line V—V of FIG. 2.

The articulation of levers 22*a* and 22*b* is achieved so that said levers 22*a*, 22*b* are mobile in the plane of fitting ring 12 and, more particularly, in recesses 26*a*, 26*b* arranged in the upper face of said fitting ring 12. In the example shown, the articulation is achieved via a flat headed screw 28*a*, 28*b* fitted in a sleeve 29 driven into the bottom of recess 26*a*, 26*b* (FIG. 5).

Each lever 22*a*, 22*b* has a generally flat shape and includes on a first side or flank a first push surface 30*a*, 30*b* which co-operates with the end of piston 18*a*, 18*b* directed towards the exterior of fitting ring 12. Preferably, and as is shown in the Figures, the first surface 30*a*, 30*b* is substantially rounded and the top of the rounded portion of the surface is in contact with the centre of piston 18*a*, 18*b* in the rest position of lever 22*a*, 22*b*, i.e. when push-button 4*a*, 4*b* is not being actuated.

Each lever 22*a*, 22*b* also has on a second side or flank, opposite to the first side, a second push surface 32*a*, 32*b* which co-operates with the actuation end 34*a*, 34*b* of push-button 4*a*, 4*b*. This second push surface 32*a*, 32*b* is perpendicular to the sliding direction of push-button 4*a*, 4*b* and is preferably formed by a straight portion of lever 22*a*, 22*b*.

The Figures also show that first and second surfaces 30*a*, 30*b* and 32*a*, 32*b* are respectively at different distances from point of articulation P, second surface 32*a*, 32*b* being further from point of articulation P than first surface 30*a*, 30*b* and that they extend on either side of the longitudinal axis L of lever 22*a*, 22*b*.

When pressure is applied onto one of push-buttons 4*a*, 4*b*, from the rest position of the device shown in a continuous line in FIG. 2, actuation end 34*a*, 34*b* of push-button 4*a*, 4*b* slides along a non-radial direction to the movement and acts on second push surface 32*a*, 32*b*. Actuation end 34*a*, 34*b* slides over push surface 32*a*, 32*b* while causing the rotation of lever 22*a*, 22*b* about point of articulation P. While this occurs, first push surface 30*a*, 30*b* slides over the end of piston 18*a*, 18*b* while pushing the latter to cause it to slide along a direction radial to movement 16 in bore 20*a*, 20*b*. The end of piston 18*a*, 18*b* directed towards the centre of movement 16 then acts on one of the start/stop or zero reset mechanisms of the chronograph. Push-button 4*a*, 4*b*, lever 22*a*, 22*b* and piston 18*a*, 18*b* are then in their working position shown in dotted lines in FIG. 2.

When pressure is no longer applied onto push-button 4*a*, 4*b*, the latter is returned to its rest position by its own return means, while lever 22*a*, 22*b* returns to its rest position by the effect of conventional return means of the mechanism which has just been actuated.

It will be noted that the embodiment shown of the actuation device according to invention does not include any particular return means, and that the return means of push-buttons 4*a*, 4*b* and of the mechanism to be actuated are advantageously used. In the event that one wishes to use simpler push-buttons, it is of course possible to provide return means on the actuation device according to the invention, for example a strip spring mounted in the recess and acting on the first flank of the lever.

According to an advantageous application, the device can allow closing of an electric contact of the movement to be achieved, for example to control the lighting of a dial.

The description of the actuation device was made within the scope of an application to a watch case of square shape including two push-buttons, but it is evident that this device can also be applied to any watch case requiring the use of one or more push-buttons which move in a non-radial direction to the movement, for example rectangular or tonneau watch cases.

What is claimed is:

1. A device for actuating a timepiece mechanism, in particular a chronograph mechanism, this timepiece including a fitting ring having an opening for accommodating a movement, an independent push-button sliding along a first direction, a piston sliding along a second direction in the fitting ring, said piston being intended to co-operate with a component of the movement and a push transmission element to transmit a push of said pushbutton to said piston, wherein the push transmission element includes a rigid actuation lever articulated at one point on the fitting ring and in the plane thereof.

2. An actuation device according to claim 1, wherein said lever includes a first push surface co-operating with said piston and a second push surface co-operating with said push-button.

3. An actuation device according to claim 2, wherein the first and second surfaces are respectively at different distances from the point of articulation of the lever, the second surface being further from the point of articulation than the first surface.

4. An actuation device according to claim 2, wherein the second surface is substantially perpendicular to the sliding direction of said pushbutton.

5. An actuation device according to claim 2, wherein the first surface is substantially rounded.

6. An actuation device according to claim 1, wherein said piston is independent of the lever and slides freely in a bore of the fitting ring.

7. An actuation device according to claim 6, wherein the piston includes an axial stop.

8. An actuation device according to claim 1, wherein the movement is circular, and wherein the second direction is radial to said movement.

9. An actuation device according to claim 1, wherein the outer contour of the fitting ring has a square or rectangular shape.

10. An actuation device according to claim 1, wherein it includes two push-buttons situated on a same side of the fitting ring.

11. A watch comprising a device for actuating a timepiece mechanism, in particular a chronograph mechanism, this timepiece including a fitting ring having an opening for accommodating a movement, an independent push-button sliding along a first direction, a piston sliding along a second direction in the fitting ring, said piston being intended to co-operate with a component of the movement and a push transmission element to transmit a push of said push-button to said piston, wherein the push transmission element includes a rigid actuation lever articulated at one point on the fitting ring and in the plane thereof.

12. A watch according to claim 11, wherein said actuation device allows a mechanism arranged inside the movement to be actuated.

13. A watch according to claim 11, wherein said actuation device allows an electric contact of the movement to be closed.

* * * * *